US010274870B2

(12) United States Patent
Gima

(10) Patent No.: US 10,274,870 B2
(45) Date of Patent: Apr. 30, 2019

(54) DEVELOPER COLLECTION DEVICE, BELT UNIT, AND IMAGE FORMING APPARATUS

(71) Applicant: Oki Data Corporation, Tokyo (JP)

(72) Inventor: Satoshi Gima, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/788,244

(22) Filed: Oct. 19, 2017

(65) Prior Publication Data

US 2018/0113400 A1 Apr. 26, 2018

(30) Foreign Application Priority Data

Oct. 26, 2016 (JP) ..... 2016-209829

(51) Int. Cl.
*G03G 15/00* (2006.01)
*G03G 15/095* (2006.01)
*G03G 21/12* (2006.01)

(52) U.S. Cl.
CPC ..... *G03G 15/095* (2013.01); *G03G 21/12* (2013.01); *G03G 15/6517* (2013.01)

(58) Field of Classification Search
CPC ..... G03G 15/095; G03G 21/10; G03G 21/12; G03G 21/105
See application file for complete search history.

(56) References Cited

U.S. PATENT DOCUMENTS

2005/0163545 A1* 7/2005 Cook ..... G03G 21/12 399/358
2012/0076522 A1* 3/2012 Amaike ..... G03G 15/168 399/66
2012/0294654 A1* 11/2012 Ninomiya ..... G03G 15/0889 399/254

FOREIGN PATENT DOCUMENTS

JP 2009-008904 A 1/2009

* cited by examiner

*Primary Examiner* — David M. Gray
*Assistant Examiner* — Andrew V Do
(74) *Attorney, Agent, or Firm* — Rabin & Berdo, P.C.

(57) ABSTRACT

A developer collection device includes a container, a frame, a first fin, and a second fin. The container has an opening, and contains a developer introduced into the container from the opening. The frame extends in a first axis direction, and is attached, to the container, swingably relative to the container in the first axis direction. The first and second fins are provided in the container, and are attached to first and second base points of the frame, respectively. The first and second fins extend in third and fourth directions from the first and second base points, respectively. The third and fourth directions are directions inclining downward and thereby forming angles that are smaller than ninety degrees relative to first and second directions, respectively. The first direction extends along the first axis direction. The second direction is a direction opposite to the first direction.

13 Claims, 11 Drawing Sheets

DEVELOPER COLLECTION DEVICE, BELT UNIT, AND IMAGE FORMING APPARATUS

CROSS REFERENCE TO RELATED APPLICATIONS

The present application claims priority from Japanese Patent Application No. 2016-209829 filed on Oct. 26, 2016, the entire contents of which are hereby incorporated by reference.

BACKGROUND

The technology relates to a developer collection device, a belt unit provided with the developer collection device, and an image forming apparatus provided with the developer collection device.

An image forming apparatus has been known that transfers a developer image onto a medium by means of a belt. There has been proposed an image forming apparatus provided with a developer collection device directed to collecting unnecessary remains of a developer on a surface of such a belt, as disclosed in Japanese Patent No. 4383468, for example.

SUMMARY

It is desired to perform an operation of collecting a developer more smoothly in a developer collection device, in an image forming apparatus, that is directed to collecting unnecessary remains of a developer on a surface of a belt.

It is desirable to provide a developer collection device that is able to perform an operation of collecting a developer more smoothly, a belt unit provided with the developer collection device, and an image forming apparatus provided with the developer collection device.

According to one embodiment of the technology, there is provided a developer collection device including a container, a frame, a first fin, and a second fin. The container has an opening, and contains a developer introduced into the container from the opening. The frame extends in a first axis direction, and is attached, to the container, swingably relative to the container in the first axis direction. The first fin is provided in the container and is attached to a first base point of the frame. The first fin extends in a third direction from the first base point. The third direction is a direction inclining downward and thereby forming an angle that is smaller than ninety degrees relative to a first direction. The first direction extends along the first axis direction. The second fin is provided in the container and is attached to a second base point of the frame. The second fin extends in a fourth direction from the second base point. The fourth direction is a direction inclining downward and thereby forming an angle that is smaller than ninety degrees relative to a second direction. The second direction is a direction opposite to the first direction.

According to one embodiment of the technology, there is provided a belt unit including: a belt to which a developer is to be attached; and a developer collection device that collects the developer attached to the belt. The developer collection device includes a container, a frame, a first fin, and a second fin. The container has an opening, and contains the developer introduced into the container from the opening. The frame extends in a first axis direction, and is attached, to the container, swingably relative to the container in the first axis direction. The first fin is provided in the container and is attached to a first base point of the frame.

The first fin extends in a third direction from the first base point. The third direction is a direction inclining downward and thereby forming an angle that is smaller than ninety degrees relative to a first direction. The first direction extends along the first axis direction. The second fin is provided in the container and is attached to a second base point of the frame. The second fin extends in a fourth direction from the second base point. The fourth direction is a direction inclining downward and thereby forming an angle that is smaller than ninety degrees relative to a second direction. The second direction is a direction opposite to the first direction.

According to one embodiment of the technology, there is provided an image forming apparatus including an image forming unit and a belt unit. The image forming unit includes an image supporting body that supports a developer image. The developer image includes a developer. The belt unit includes a belt and a developer collection device. The belt conveys a medium while sandwiching the medium between the image supporting body and the belt. The developer collection device collects the developer attached to the belt. The developer collection device includes a container, a frame, a first fin, and a second fin. The container has an opening, and contains the developer introduced into the container from the opening. The frame extends in a first axis direction, and is attached, to the container, swingably relative to the container in the first axis direction. The first fin is provided in the container and is attached to a first base point of the frame. The first fin extends in a third direction from the first base point. The third direction is a direction inclining downward and thereby forming an angle that is smaller than ninety degrees relative to a first direction. The first direction extends along the first axis direction. The second fin is provided in the container and is attached to a second base point of the frame. The second fin extends in a fourth direction from the second base point. The fourth direction is a direction inclining downward and thereby forming an angle that is smaller than ninety degrees relative to a second direction. The second direction is a direction opposite to the first direction.

DETAILED DESCRIPTION

Some example embodiments of the technology are described below in detail with reference to the accompanying drawings. It is to be noted that the description below refers to mere specific examples of the technology, and the technology is therefore not limited thereto. Further, the technology is not limited to factors such as arrangements, dimensions, and dimension ratios of components illustrated in the respective drawings. The elements in the following example embodiments which are not recited in a most-generic independent claim of the technology are optional and may be provided on an as-needed basis. The description is given in the following order.

1. Example Embodiment

An image forming apparatus provided with a belt unit including a developer collection device 2. Modification Examples

1. Example Embodiment

1.1 Outline Configuration of Image Forming Apparatus 1

Figure 1A:
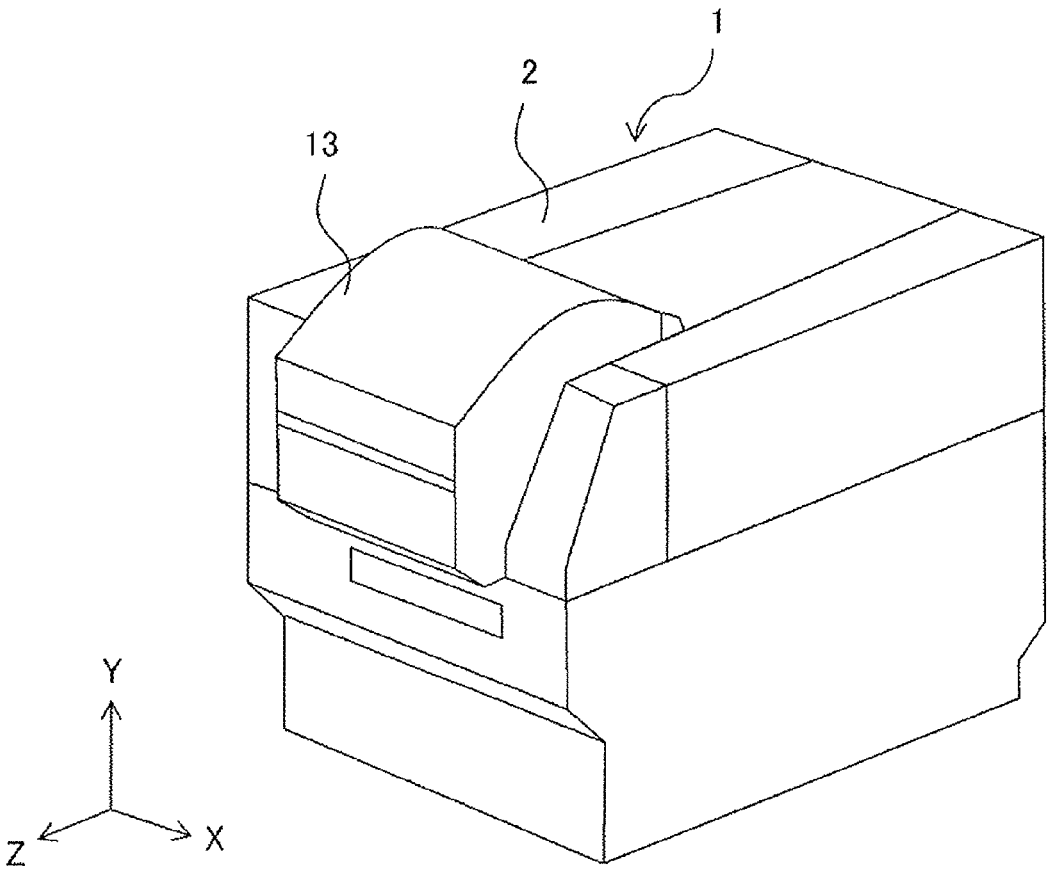
FIG. 1A is a perspective view of an example of an overall configuration of an image forming apparatus according to one example embodiment of the technology.
Figure 1B:
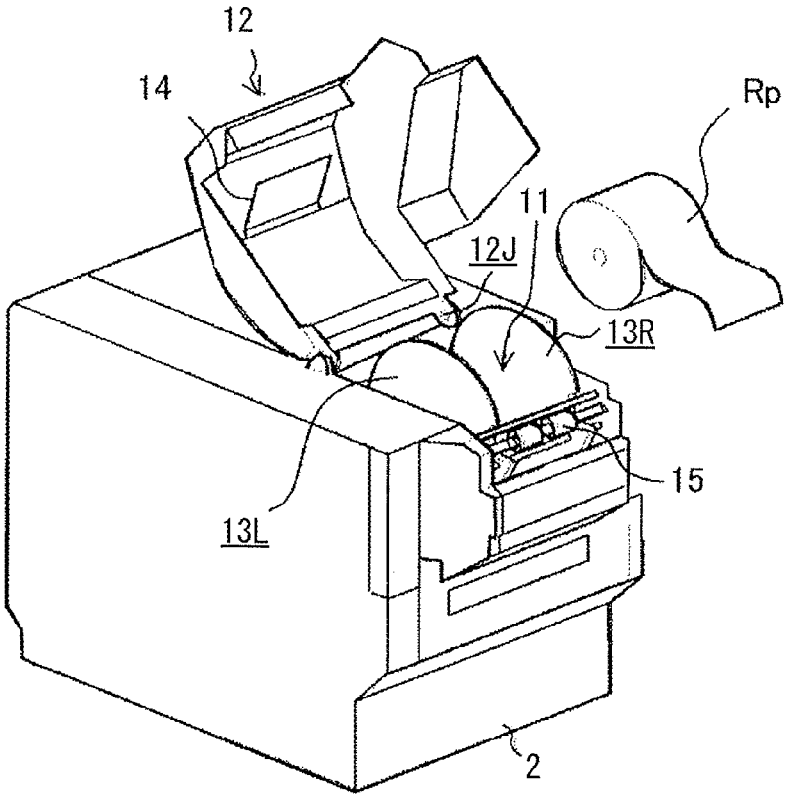
FIG. 1B is another perspective view of an example of the overall configuration of the image forming apparatus illustrated in FIG. 1A.
Figure 2:
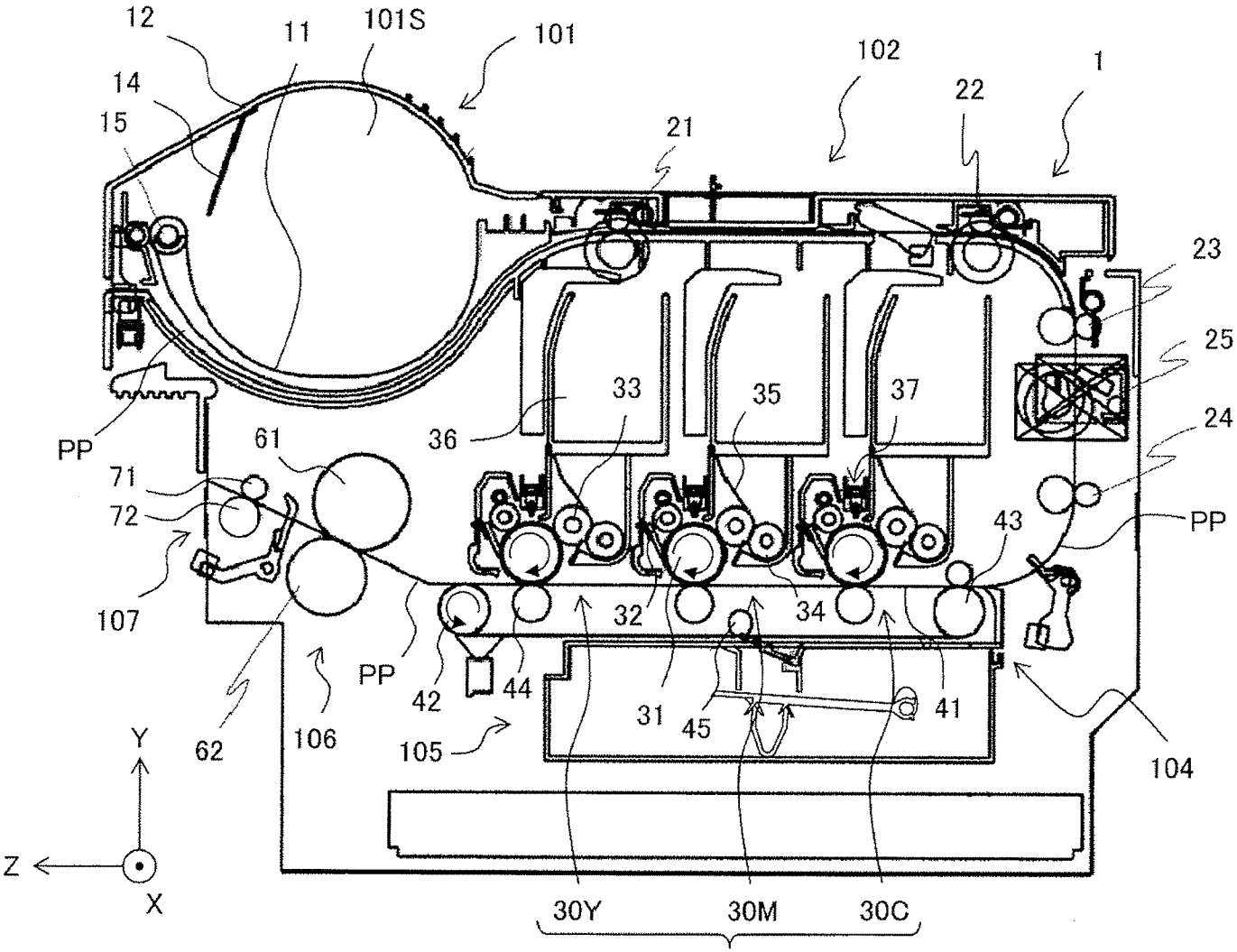
FIG. 2 schematically illustrates an internal structure of the image forming apparatus illustrated in FIG. 1A.
Figure 3:
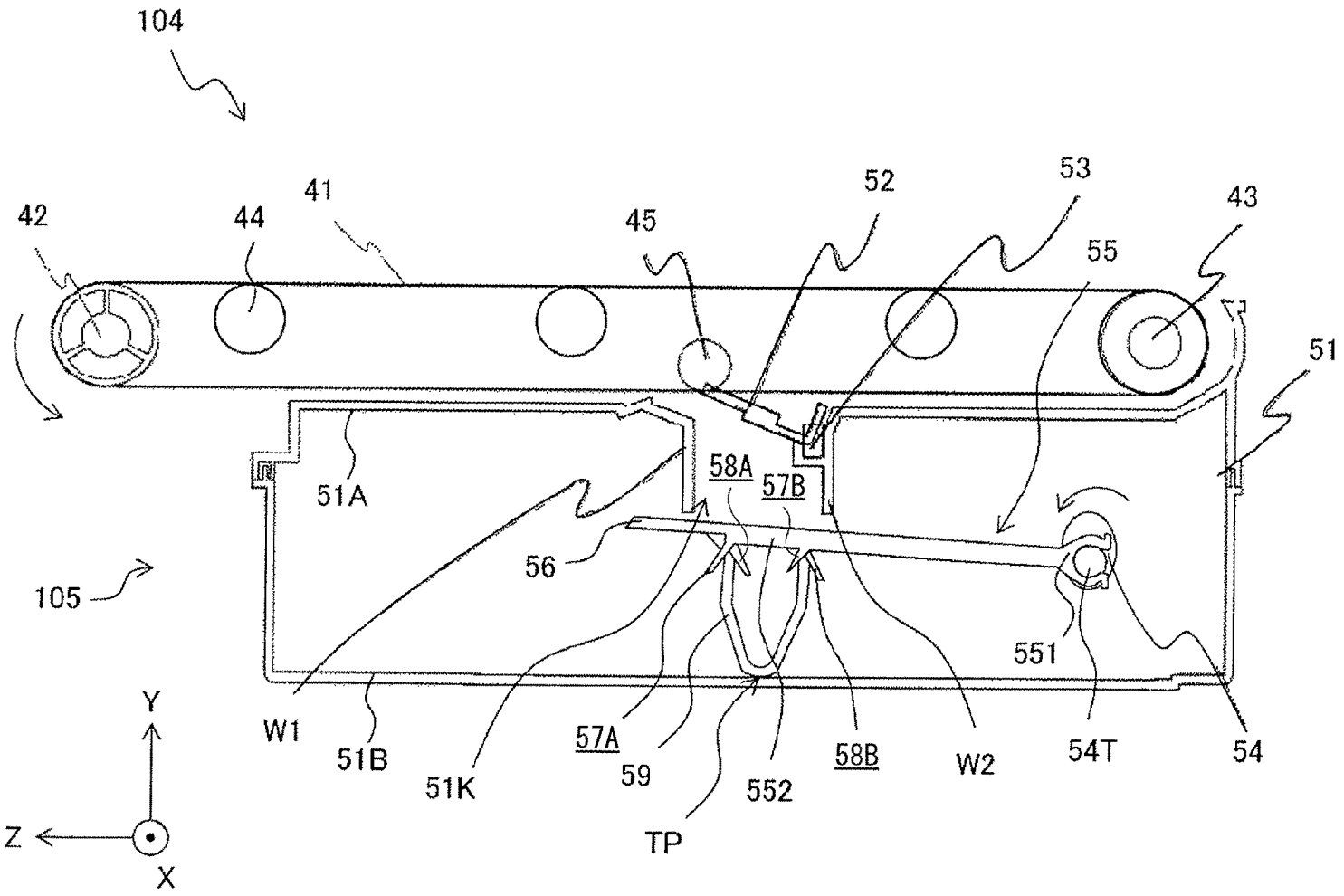
FIG. 3 schematically illustrates an example of a configuration of a belt unit illustrated in FIG. 2.

FIG. 1A is a perspective view of an appearance of an image forming apparatus 1 according to one example embodiment of the technology. FIG. 1B is a perspective view of the image forming apparatus 1 illustrated in FIG. 1A in which part of an internal configuration of the image forming apparatus 1 is viewable. FIG. 2 schematically illustrates an example of an internal configuration of the image forming apparatus 1 illustrated in FIGS. 1A and 1B as a whole. FIG. 3 schematically illustrates an example of a main part inside the image forming apparatus 1.

The image forming apparatus 1 may include, for example, inside a housing 2, a medium feeding unit 101, a medium conveying unit 102, an image former 103, a transfer device 104, a developer collection device 105, a fixing device 106, and a discharging unit 107, for example. The image forming apparatus 1 may further include a conveyance path PP. The conveyance path PP may be a path along which a medium travels, and that is set from the medium feeding unit 101 to outside of the housing 2 eventually. Specifically, the conveyance path PP may sequentially pass through the medium feeding unit 101, the medium conveying unit 102, the image former 103, the transfer device 104, the developer collection device 105, the fixing device 106, and the discharging unit 107, and travel to the outside of the housing 2. It is to be noted that, herein, a direction from any selected position on the conveyance path PP toward the medium feeding unit 101 or a position that is closer to the medium feeding unit 101 than any selected position, i.e., a position between the selected position and the medium feeding unit 101, is referred to as "upstream" of the selected position. A direction from any selected position on the conveyance path PP away from the medium feeding unit 101 or a position that is closer to the discharging unit 107 than any selected position, i.e., a position between the selected position and the discharging unit 107, is referred to as "downstream" of the selected position.

In this example, the developer collection device 105 may correspond to a "developer collection device" in a specific but non-limiting embodiment of the technology. Further, the developer collection device 105 and the transfer device 104 together may correspond to a "belt unit" in a specific but non-limiting embodiment of the technology.

[Medium Feeding Unit 101]

The medium feeding unit 101 may include a holder 11, a cover 12, a pair of side guides 13L and 13R, a guide 14, and a conveying roller 15. The guide 14 may be protruded on an internal surface of the cover 12. The holder 11 may hold a roll Rp that serves as a feeding source of the medium on which an image is to be formed. The holder 11 may form, together with the cover 12, space 101S that contains the roll Rp. The cover 12 may be a protection member that covers the roll Rp contained in the space 101S. The roll Rp may be a continuous wound sheet that serves as the medium, for example. It is to be noted that, alternatively, the medium may be a continuous sheet on which a plurality of stickers are provided at intervals. Further, a material of the continuous sheet may be paper; however, the material of the continuous sheet is not limited thereto. For example, the material of the continuous paper may be a material such as transparent resin. The pair of side guides 13L and 13R may guide respective side surfaces of the roll Rp contained in the space 101S. The guide 14 may so guide the path of the medium that the medium drawn out from the roll Rp stably travels toward the conveyance path PP. The conveying roller 15 may draw the medium out from the roll Rp, and sequentially convey the drawn-out medium toward the medium conveying unit 102. The medium feeding unit 101 may further include a medium feeding motor 811 illustrated in FIG. 5 which will be referred to later. The conveying roller 15 may be driven to rotate by the medium feeding motor 811.

[Medium Conveying Unit 102]

The medium conveying unit 102 may include pairs of conveying rollers 21 to 24 and a cutter 25. The pairs of conveying rollers 21 to 24 may be disposed in order from the upstream to the downstream along the conveyance path PP. The pairs of conveying rollers 21 to 24 may convey the medium drawn out from the medium feeding unit 101 toward the image former 103 and the transfer device 104 that are located downstream of the medium feeding unit 101. The cutter 25 may be disposed between the pair of conveying rollers 23 and the pair of conveying rollers 24. The cutter 25 may cut the conveyed medium at a predetermined length. The medium conveying unit 102 may further include a conveyance motor 812 illustrated in FIG. 5 which will be referred to later. The pairs of conveying rollers 21 to 24 and the cutter 25 may be driven by the conveyance motor 812.

[Image Former 103]

The image former 103 may be located downstream of the medium conveying unit 102. The image former 103 may include image forming units 30Y, 30M, and 30C that are disposed in order from the upstream along the conveyance path PP. Each of the image forming units 30Y, 30M, and 30C may include a photosensitive drum 31, a charging roller 32, a developing roller 33, a feeding roller 34, a development blade 35, a developer container 36, and a light-emitting diode (LED) head 37. Each of the image forming units 30Y, 30M, and 30C may form a developer image (a toner image) of its color on a surface of the corresponding photosensitive drum 31. The image forming units 30Y, 30M, and 30C may form the respective developer images (the toner images) by the use of developers (toners) having colors different from each other. Specifically, for example, the image forming unit 30C may form a cyan developer image by the use of a cyan developer. The image forming unit 30M may form a magenta developer image by the use of a magenta developer. The image forming unit 30Y may form a yellow developer image by the use of a yellow developer. The image former 103 may further include a driving motor DM illustrated in FIG. 5 which will be referred to later. The members such as the photosensitive drums 31 may be driven to rotate by the driving motor DM.

Each of the photosensitive drums 31 may be a substantially-cylindrical member and have a surface (a surficial part) supporting an electrostatic latent image. Each of the photosensitive drums 31 may include a photoreceptor such as an organic photoreceptor. Each of the photosensitive drums 31 may rotate in a predetermined direction at a predetermined circumferential velocity. In one example embodiment, each of the photosensitive drums 31 may rotate clockwise as indicated by an arrow illustrated in FIG. 2.

Each of the charging rollers 32 may electrically charge the surface (the surficial part) of corresponding one of the photosensitive drums 31. Each of the charging rollers 32 may be so disposed as to be in contact with a surface (a circumferential surface) of the corresponding photosensitive drum 31. In one example embodiment, each of the charging rollers 32 may rotate anticlockwise.

Each of the developing rollers 33 may have a surface supporting the developer that develops the electrostatic latent image. Each of the developing rollers 33 may be so disposed as to be in contact with the surface (the circumferential surface) of corresponding one of the photosensitive drums 31. In one example embodiment, each of the developing rollers 33 may rotate anticlockwise.

Each of the feeding rollers 34 may be a member (a feeding member) that feeds the developer to corresponding one of the developing rollers 33. Each of the feeding rollers 34 may be so disposed as to be in contact with a surface (a circumferential surface) of the corresponding developing roller 33. In one example embodiment, each of the feeding rollers 34 may rotate anticlockwise, i.e., in a direction same as that of the developing rollers 33.

Each of the development blades 35 may be a developer controlling member that forms a layer (a developer layer), including a developer, on corresponding one of the developer rollers 33 while the corresponding developer roller 33 rotates, and controls (or adjusts) a thickness of the developer layer. Each of the development blades 35 may be a plate-like elastic member including a material such as stainless steel, for example. Each of the development blades 35 may be so disposed that an end of the plate-like elastic member is disposed in the vicinity of the surface of the corresponding developing roller 33. Non-limiting examples of the plate-like elastic member may include a plate spring.

Each of the developer containers 36 may be a container that contains a developer of a predetermined color. Each of the developer containers 36 may have a developer discharging opening at a lower part of the developer container 36, for example.

Each of the LED heads 37 may perform exposure on the surface of corresponding one of the photosensitive drums 31 that faces the LED head 37, and thereby form an electrostatic latent image on the surface of the corresponding photosensitive drum 31.

[Transfer Device 104]

The transfer device 104 may be so disposed below the image former 103 as to face the image former 103 with the conveyance path PP in between. Referring to FIG. 3, the transfer device 104 may include a conveyance belt 41, a driving roller 42, a driven roller 43, a transfer roller 44, and a contact roller 45. The driving roller 42 may drive the conveyance belt 41. The transfer roller 44 may be driven to rotate by the driving motor DM.

The conveyance belt 41 may be directed to conveying the medium toward the downstream along the conveyance path PP. Specifically, the conveyance belt 41 may be an endless elastic belt including a resin material such as polyimide resin, for example. The conveyance belt 41 may lie on members such as the driving roller 42, the driven roller 43, the transfer roller 44, and the contact roller 45, while being stretched. The conveyance belt 41 may rotate circularly anticlockwise in one example illustrated in FIG. 2. The driven roller 43 may be rotated in accordance with the rotation of the driving roller 42 and the conveyance belt 41. The transfer roller 44 may be a member directed to electrostatically transferring, onto the medium, the developer image formed in the image former 103. The transfer roller 44 may face the photosensitive drums 31 with the conveyance belt 41 in between. The contact roller 45 may face a cleaning blade 52, of the developer collection device 105, which will be described later with the conveyance belt 41 in between. The contact roller 45 may press the conveyance belt 41 against the cleaning blade 52.

[Developer Collection Device 105]

The developer collection device 105 may be disposed below the transfer device 104. The developer collection device 105 may collect an unnecessary developer attached to the conveyance belt 41. The developer collection device 105 will be described later in greater detail.

[Fixing Device 106]

The fixing device 106 may be located downstream of the image former 103 and the transfer device 104. The fixing device 106 may have a function that fixes the developer image to the medium by applying heat and pressure to the developer image that has been transferred onto the medium conveyed from the transfer device 104. The fixing device 106 may include a fixing roller 61 and a pressure-applying roller 62. The fixing roller 61 may be provided with a heater 791, illustrated in FIG. 5 which will be referred to later, that is built in the fixing roller 61. The pressure-applying roller 62 may be so disposed that the fixing roller 61 and the pressure-applying roller 62 sandwich the medium travelling along the conveyance path PP in between. The fixing device 106 may further include a thermistor 792, illustrated in FIG. 5 which will be referred to later, that detects a temperature of the fixing device 106. The fixing roller 61 may be driven to rotate by a member such as the driving motor DM, for example.

[Discharging Unit 107]

The discharging unit 107 may include discharging rollers 71 and 72 that face each other, for example. The discharging rollers 71 and 72 may be driven to rotate by a member such as the driving motor DM, for example, and thereby discharge the medium discharged from the fixing device 106 to the outside.

1.2 Configuration of Developer Collection Device 105

Figure 4:
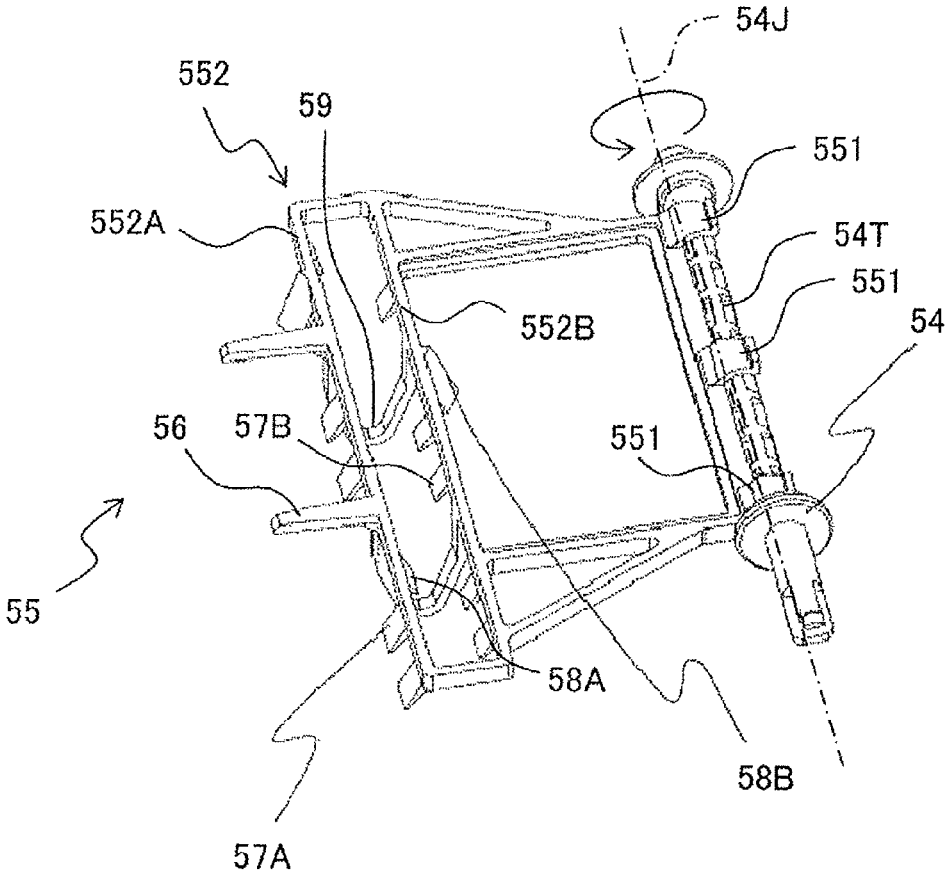
FIG. 4 is an enlarged perspective view of part of a developer collection device illustrated in FIG. 2.

A description is given next of a detailed configuration of the developer collection device 105, with reference to FIGS. 3 and 4. Referring to FIG. 3, the developer collection device 105 may include a container 51, the cleaning blade 52, a sealing member 53, a rotating member 54, and a frame 55. FIG. 4 is a perspective view of a configuration of the rotating member 54 and the frame 55. The cleaning blade 52 may extend in an X-axis direction. The cleaning blade 52 may be in contact with a surface of the conveyance belt 41 that rotates circularly, and thereby scrape off the unnecessary developer (a waste toner) attached to the surface of the conveyance belt 41. The cleaning blade 52 may thus remove the unnecessary developer from the surface of the conveyance belt 41. The contact roller 45 that faces the cleaning blade 52 with the conveyance belt 41 in between may bias the conveyance belt 41 against the cleaning blade 52. Therefore, the cleaning blade 52 may be brought into contact with the surface of the conveyance belt 41 at a predetermined pressure.

The container 51 may have space that contains the developer scraped off by the cleaning blade 52. The developer scraped off by the cleaning blade 52 is hereinafter referred to as the "waste toner". The container 51 may include an upper part 51A and a lower part 51B that are fit to each other and face each other in a vertical direction, for example. An opening 51K may be provided at a position, in the upper part 51A, corresponding to the cleaning blade 52. The opening 51K may allow the waste toner to be introduced into the container 51 from the opening 51K. Further, a peripheral edge of the opening 51K may be provided with walls W1 and W2 that are protruded toward inside of the container 51. In this example, the container 51 may correspond to a "container" in one specific but non-limiting embodiment of the technology. The opening 51K may correspond to an "opening" in one specific but non-limiting embodiment of the technology. The walls W1 and W2 may correspond to a "wall" in one specific but non-limiting embodiment of the technology.

The rotating member 54 and the frame 55 may be provided inside the container 51. The rotating member 54 and the frame 55 may have a function that causes the waste toner accumulated inside the container 51 to move in a horizontal direction, i.e., a Z-axis direction, and thereby moderates imbalance in thickness (height) of the waste toner accumulated inside the container 51, i.e, allows the thickness (the height) of the waste toner to be even.

The rotating member 54 may rotate by itself around a rotational axis 54J illustrated in FIG. 4, and include a shaft 54T. The rotational axis 54J may extend in the X-axis direction. Hereinafter, the X-axis direction may be also referred to as a "second axis direction". The shaft 54T may extend in the X-axis direction, and revolve around the rotational axis 54J. In other words, the shaft 54T may be located at a position off the rotational axis 54J. In this example, the rotating member 54 may correspond to an "attachment member" in one specific but non-limiting embodiment of the technology. The rotating member 54 may also correspond to a "rotating member" in one specific but non-limiting embodiment of the technology. The shaft 54T may correspond to a "shaft" in one specific but non-limiting embodiment of the technology. It is to be noted that, in one example embodiment, the rotating member 54 may be attached to the container 51 displaceably in the horizontal direction, i.e., the Z-axis direction, for example.

The frame may include a base 551 and an end 552. The frame is attached to the container 51 swingably relative to the container 51. Specifically, the base 551 may be attached to the shaft 54T pivotally relative to the shaft 54T. To the end 552, fins 57A and 57B and fins 58A and 58B may be attached. The base 551 and the end 552 may be located on opposite side to each other in a direction substantially orthogonal to the rotational axis 54J. Hereinafter, the direction substantially orthogonal to the rotational axis 54J may be also referred to as a "first axis direction". The end 552 may include a part 552A and a part 552B that both extend in the X-axis direction. The part 552A and the part 552B may be disposed side by side in the first axis direction, i.e., a direction linking the base 551 and the end 552 to each other. The wall W1 and the wall W2 may face each other in the first axis direction. The fin 57A may so extend from the part 552A, as a base point, of the end 552 in a third direction as to be away from the rotating member 54. The third direction may be different from both the second axis direction, i.e., the X-axis direction, and the first axis direction, i.e., a direction in which the frame 55 extends. Further, the fin 57B may so extend from the part 552B, as a base point, of the end 552 in the third direction as to be away from the rotating member 54. The third direction may be a direction that so inclines downward as to form an angle that is smaller than 90° relative to a first direction. The first direction may extend along the first axis direction, and be roughly coincident with +Z direction. In contrast, the fin 58A may so extend from the part 552A, as a base point, in a fourth direction as to be closer to the rotating member 54. Further, the fin 58B may so extend from the part 552B, as a base point, in the fourth direction as to be closer to the rotating member 54. The fourth direction may be a direction that so inclines downward as to form an angle that is smaller than 90° relative to a second direction. The second direction may be a direction opposite to the first direction extending along the first axis direction, and be roughly coincident with −Z direction. In this example, the frame 55 may correspond to a "frame" in one specific but non-limiting embodiment of the technology. The fin 57A and the fin 58B may correspond to a "first fin" and a "second fin", respectively, in one specific but non-limiting embodiment of the technology, or the fin 57B and the fin 58A may correspond to the "first fin" and the "second fin", respectively, in one specific but non-limiting embodiment of the technology.

The frame 55 may include a contact 59 that is able to be brought into contact with the lower part 51B of the container 51. Each of the fins 57A and 58A may be located at a forward position of the contact point TP at which the contact 59 and the lower part 51B are brought into contact with each other. Each of the fins 57B and 58B may be located at a rearward position of the contact point TP at which the contact 59 and the lower part 51B are brought into contact with each other. The term "forward" position used herein refers to a position, on the frame 55, that is relatively farther from the rotating member 54 compared to any selected position on the frame 55. The term "rearward" position used herein refers to a position, on the frame 55, that is relatively closer to the rotating member 54 compared to any selected position on the frame 55. The position of the contact point TP may be varied by the movement of the frame 55 in the Z-axis direction accompanying the rotation operation of the rotating member 54. The contact 59 may correspond to a "second contact" in one specific but non-limiting embodiment of the technology. Further, the frame 55 may include a contact 56 that is able to be brought into contact with the wall W1 from a position below the wall W1, for example.

The contact 56 may protrude forward from the part 552A, for example. The contact 56 may correspond to a "first contact" in one specific but non-limiting embodiment of the technology.

1.3 Circuit Configuration of Image Forming Apparatus 1

Figure 5:
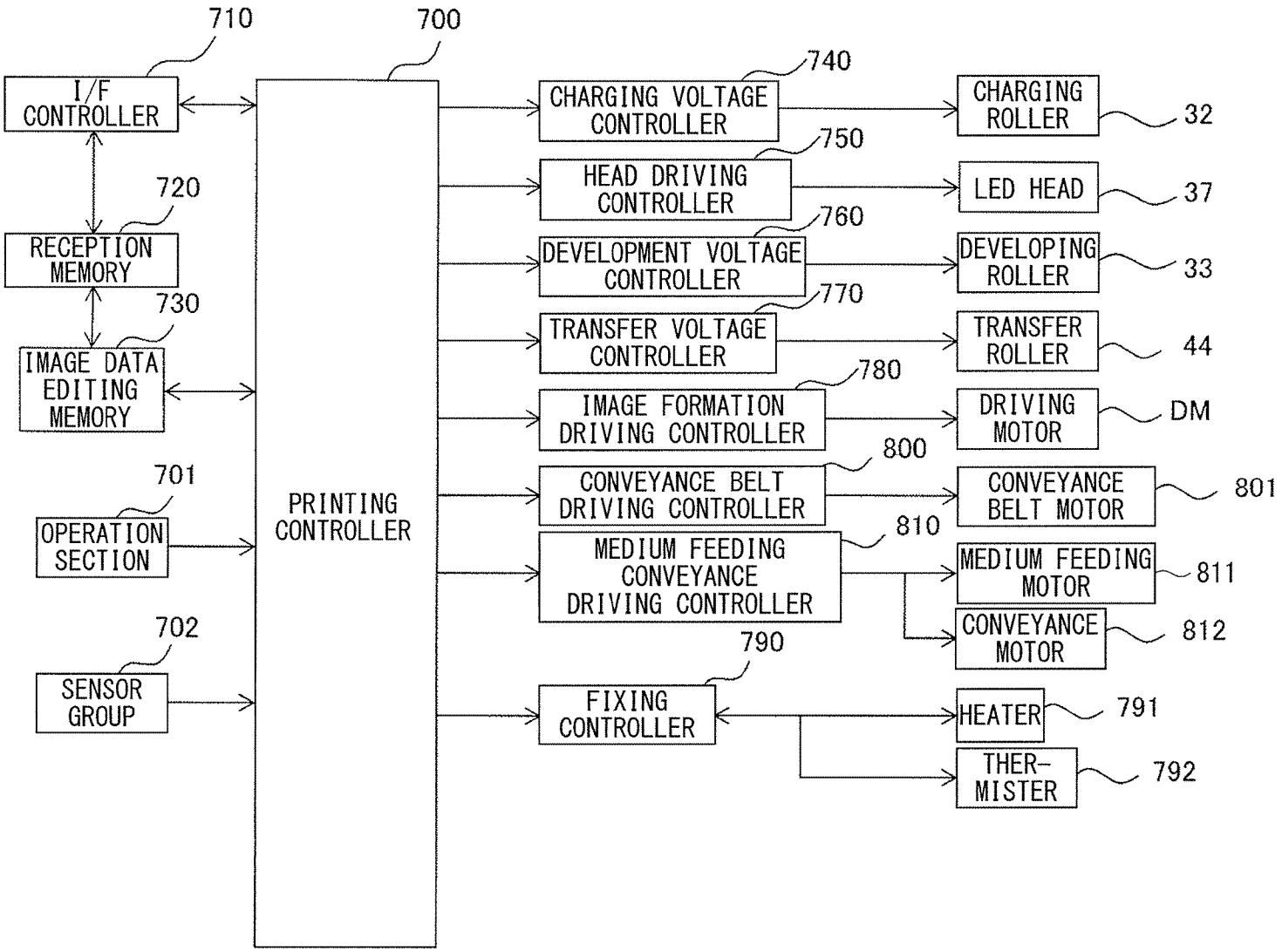
FIG. 5 is a block diagram schematically illustrating an example of an internal configuration of the image forming apparatus illustrated in FIG. 1A.

FIG. 5 is a block diagram schematically illustrating an internal configuration of the image forming apparatus 1. Referring to FIG. 5, the image forming apparatus 1 may include a printing controller 700, an interface (I/F) controller 710, a reception memory 720, an image data editing memory 730, an operation unit 701, and a sensor group 702. The image forming apparatus 1 may further include a charging voltage controller 740, a head driving controller 750, a development voltage controller 760, a transfer voltage controller 770, an image formation driving controller 780, a fixing controller 790, a conveyance belt driving controller 800, and a medium feeding conveyance driving controller 810, that each receive an instruction given by the printing controller 700.

The printing controller 700 may include components such as a microprocessor, a read-only memory (ROM), a random access memory (RAM), and an input-output port. The printing controller 700 may control a process operation of the image forming apparatus 1 as a whole by executing a predetermined program, for example. Specifically, the printing controller 700 may receive, for example, print data and a control command from the I/F controller 710, and perform a general control of the charging voltage controller 740, the head driving controller 750, the development voltage controller 760, the transfer voltage controller 770, the image formation driving controller 780, the fixing controller 790, the conveyance belt driving controller 800, and the medium feeding conveyance driving controller 810, to thereby perform a printing operation.

The I/F controller 710 may receive, for example, print data and a control command from an external device such as a personal computer (PC), and transmit a signal related to a state of the image forming apparatus 1.

The reception memory 720 may temporarily store the print data received from the external device such as the PC via the I/F controller 710.

The image data editing memory 730 may receive the print data stored in the reception memory 720, and store image data derived from editing of the received print data.

The operation unit 701 may include components such as an LED lamp that is directed to displaying information such as the state of the image forming apparatus 1, and an input unit that is directed to user's giving instruction to the image forming apparatus. Non-limiting examples of the input unit may include a button and a touch panel.

The sensor group 702 may include various sensors that monitor an operation state of the image forming apparatus 1. Non-limiting examples of the various sensors may include a position sensor that detects the position of the medium, a temperature sensor that detects a temperature inside the image forming apparatus 1, and a print density sensor.

In response to the instruction given by the printing controller 700, the charging voltage controller 740 may apply a charging voltage to each of the charging rollers 32 and so perform a control that the surface of each of the photosensitive drums 31 is electrically charged.

The head driving controller 750 may perform a control of an exposure operation performed by each of the LED heads 37 in accordance with the image data stored in the image data editing memory 730.

In response to the instruction given by the printing controller 700, the development voltage controller 760 may apply a development voltage to each of the developing rollers 33, and so perform a control that the toner is developed on the electrostatic latent image formed on the surface of each of the photosensitive drums 31.

In response to the instruction given by the printing controller 700, the transfer voltage controller 770 may apply a transfer voltage to the transfer roller 44, and so perform a control that the toner images are transferred onto the medium.

In response to the instruction given by the printing controller 700, the image formation driving controller 780 may perform a driving control of the driving motor DM. The driving motor DM may perform rotation driving of members such as the photosensitive drums 31.

In response to the instruction given by the printing controller 700, the fixing controller 790 may control a fixing operation performed by the fixing device 106. Specifically, the fixing controller 790 may perform a control of a voltage to be applied to the heater 791 built in the fixing roller 61 and illustrated in FIG. 5. The fixing controller 790 may perform an ON-OFF control of the voltage to be applied to the heater 791, on the basis of the temperature of the fixing device 106 measured by the thermistor 792.

In response to the instruction given by the printing controller 700, the conveyance belt driving controller 800 may perform an operation control of the conveyance belt motor 801 provided in the image forming apparatus 1. The conveyance belt motor 801 may perform driving of the conveyance belt 41.

In response to the instruction given by the printing controller 700, the medium feeding conveyance driving controller 810 may perform an operation control of the medium feeding motor 811 and the conveyance motor 812 provided in the image forming apparatus 1.

1.4 Example Workings and Example Effects

[A. Basic Operation]

The image forming apparatus 1 may transfer the developer image onto the medium as follows.

Specifically, first, the medium feeding motor 811 may be driven on the basis of the control performed by the medium feeding conveyance driving controller 810, and the conveying roller 15 may be caused to rotate. This allows the medium to be picked up from the roll Rp contained in the space 101S of the medium feeding unit 101. The picked-up medium may be drawn out toward the medium conveying unit 102 that is located downstream of the medium feeding unit 101. Thereafter, the medium drawn out from the roll Rp may be conveyed toward the image former 103 and the transfer device 104 that are located downstream of the medium conveying unit 102, while a skew of the medium is corrected by the medium conveying unit 102. In the medium conveying unit 102, the medium may be cut at a predetermined length by the cutter 25.

The image former 103 and the transfer device 104 may transfer the toner image onto the medium as follows. First, the print image data and a printing order may be inputted to the printing controller 700 of the activated image forming apparatus 1 from the external device such as the PC via the I/F controller 710. The printing controller 700 may start a printing operation of the print image data, in association with units such as the image formation driving controller 780, in response to the inputted printing order.

The image formation driving controller 780 may drive the driving motor DM, and cause each of the photosensitive drums 31 to rotate in the predetermined rotation direction at the constant velocity. When each of the photosensitive drums 31 rotates, driving force derived from the rotation of the photosensitive drum 31 may be transmitted to corresponding one of the feeding rollers 34, corresponding one of the developing rollers 33, and corresponding one of the charging rollers 32, via a driving transmitter such as a gear train. As a result, each of the feeding rollers 34, the developing rollers 33, and the charging rollers 32 may rotate in the predetermined direction.

Further, in response to the instruction given by the printing controller 700, the charging voltage controller 740 may apply a predetermined voltage to each of the charging rollers 32, and thereby electrically charge the surface of corresponding one of the photosensitive drums 31 evenly.

Thereafter, the head driving controller 750 may activate each of the LED heads 37 to thereby apply corresponding one of the photosensitive drums 31 with light corresponding to the print image based on an image signal. The electrostatic latent image may be thereby formed on the surface of the corresponding photosensitive drum 31. Further, the developer may be fed to each of the feeding rollers 34 from corresponding one of the developer containers 36. The developer may be supported by the corresponding feeding roller 34, and be moved to the vicinity of corresponding one of the developing rollers 33 in accordance with the rotation of the corresponding feeding roller 34. The developer may be electrically charged, for example, negatively, on the basis of a potential difference between a potential of the corresponding developing roller 33 and a potential of the corresponding feeding roller 34. The negatively-charged developer may be fed to the corresponding developing roller 33. The developer fed to each of the developer rollers 33 may form a developer layer having a predetermined thickness that is controlled by corresponding one of the development blades 35.

Further, the developer layer on each of the developing rollers 33 may be developed, and the developer image may be thereby formed on corresponding one of the photosensitive drums 31, on the basis of the electrostatic latent image formed on the surface of the corresponding photosensitive drum 31. The developer image may be transferred onto the medium traveling on the conveyance path PP by an electric field between the corresponding photosensitive drum 31 and the transfer roller 44. The transfer roller 44 may face each of the photosensitive drums 31, and receive a predetermined voltage applied by the transfer voltage controller 770.

Thereafter, the fixing device 106 may apply heat and pressure to the developer image transferred onto the medium, and thereby fix the developer image to the medium. Thereafter, the medium to which the developer is fixed may be discharged to the outside by the discharging unit 107.

It is to be noted that part of the developer may not be transferred onto the medium and possibly remain slightly on any of the photosensitive drums 31 in some cases. In such a case, the remaining developer may be attached to the conveyance belt 41. To address this, the developer attached to the conveyance belt 41 may be collected by the developer collection device 105 as a waste toner, in the image forming apparatus 1. A detailed description is given below of an operation of the developer collection device 105.

[B. Operation of Developer Collection Device 105]

In the developer collection device 105, a state of the frame 55, specifically, a position and a posture of the frame 55, may be displaced sequentially as illustrated in FIGS. 6A to 6D, by the rotation operation of the rotating member 54 around the rotational axis 54J, for example. In this example, the rotating member 54 may rotate anticlockwise on the paper plane of each of FIGS. 6A to 6D. Specifically, the state of the frame 55 may be varied in order of a state P1, a state P2, a state P3, and a state P4. The state of the frame 55 may be varied in repetition of the foregoing order of the states. The foregoing variation in the state of the frame 55 may allow the waste toner introduced into the container 51 to be flat in the vicinity of an uppermost layer of the waste toner. This moderates variations in thickness of accumulation of the waste toner. As a result, a greater amount of the waste toner is allowed to be collected promptly into the container 51 without overflowing from the opening 51K. It is to be noted that, in one example embodiment, the developer collecting operation of the developer collection device 105 may be performed in association with a running operation of the image former 103.

Figure 6A:
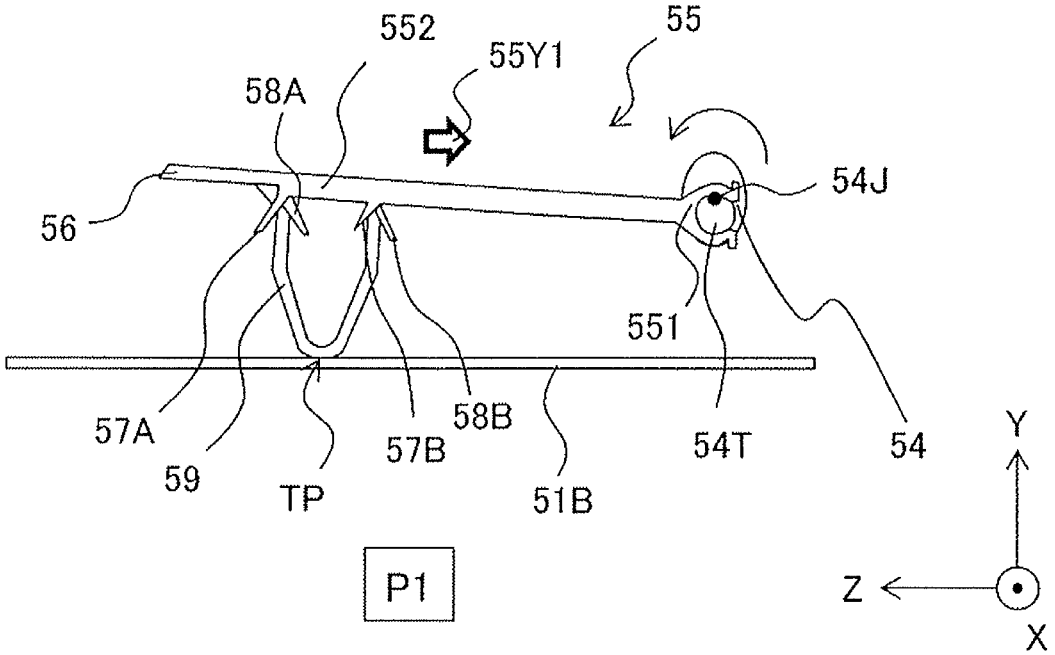
FIG. 6A is a first diagram describing an operation of the developer collection device illustrated in FIG. 2.

The state P1 illustrated in FIG. 6A may be a state in which the shaft 54T is located at its lowest position in a Y-axis direction. The shaft 54T may be located at a position slightly off the rotational axis 54J that is the center of the rotation of the rotating member 54. In other words, the state P1 may be a state in which the shaft 54T is located at its position closest to the lower part 51B. The state P3 illustrated in FIG. 6C may be a state in which the shaft 54T is located at its highest position in the Y-axis direction. In other words, the state P3 may be a state in which the shaft 54T is located at its position closest to the upper part 51A. The state P2 illustrated in FIG. 6B may be a state in the middle of the variation of the state of the frame 55 from the state P1 to the state P3. Specifically, the state P2 may be a state in which the shaft 54T is located at a position on the opposite side of the rotational axis 54J to the end 552 of the frame 55. The state P4 illustrated in FIG. 6D may be a state in the middle of the variation of the state of the frame 55 from the state P3 to the state P1. Specifically, the state P4 may be a state in which the shaft 54T is located at a position between the rotational axis 54J and the end 552 of the frame 55. It is to be noted that, in the states P1 to P4, the state in which the contact 59 and the lower part 51B are brought into contact with each other may be maintained as illustrated in FIGS. 6A to 6D, when no waste toner DT is present inside the container 51 or when the amount of the waste toner DT present inside the container 51 is little in a case where the waste toner DT is present inside the container. Therefore, the frame 55 may behave as a "lever" with the contact point TP serving as the fulcrum of the lever. It is to be noted that the contact point TP may be moved in the Z-axis direction.

In the state P1 illustrated in FIG. 6A, the base 551 attached to the shaft 54T is located at its lowest position in the Y-axis direction among the states P1 to P4. Therefore, each of the fins 57A and 58A and the contact 56 that are located on the opposite side of the contact point TP serving as the fulcrum to the base 551, i.e., that are located at respective forward positions of the contact point TP, may be located at its highest position in the Y-axis direction among the states P1 to P4. It is to be noted that each of the fins 57B and 58B that are present between the contact point TP and the base 551, i.e., that are present at respective rearward positions of the contact point TP, may be located at its lowest position in the Y-axis direction among the states P1 to P4.

Figure 6B:
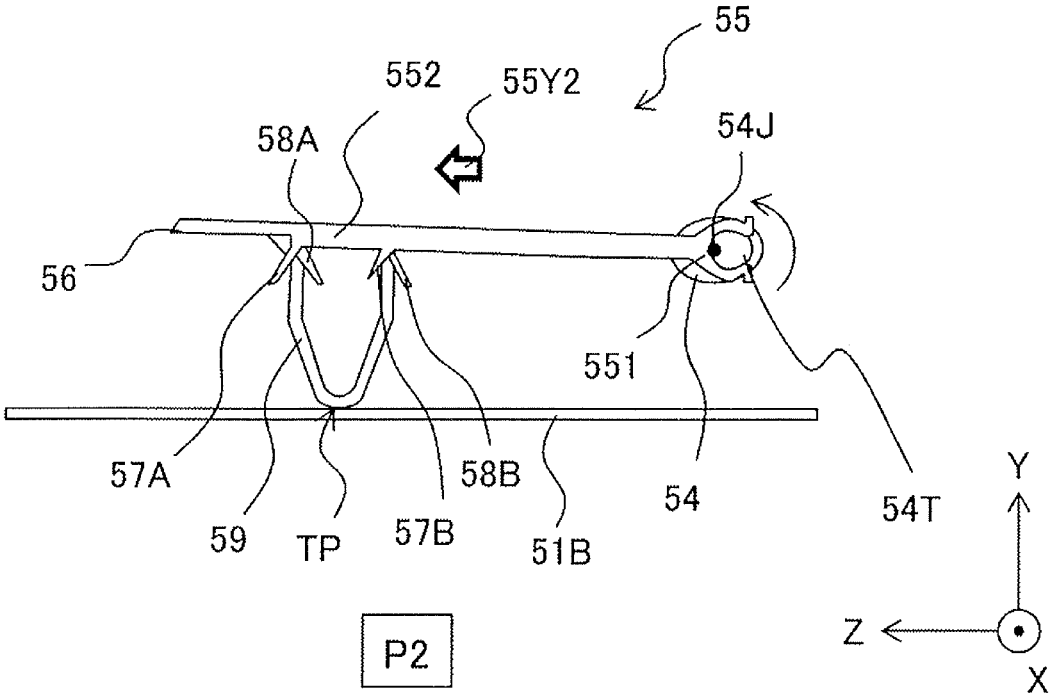
FIG. 6B is a second diagram describing the operation of the developer collection device illustrated in FIG. 2.

When the state of the frame 55 is varied from the state P1 illustrated in FIG. 6A to the state P2 illustrated in FIG. 6B, the frame 55 as a whole may be moved gradually in the −Z direction as indicated by a thick arrow 55Y1 in FIG. 6A. Upon such a movement of the frame 55, the base 551 and the fins 57B and 58B may rise gradually in the Y-axis direction, and in contrast, the fins 57A and 58A and the contact 56 may fall gradually in the Y-axis direction.

Figure 6C:
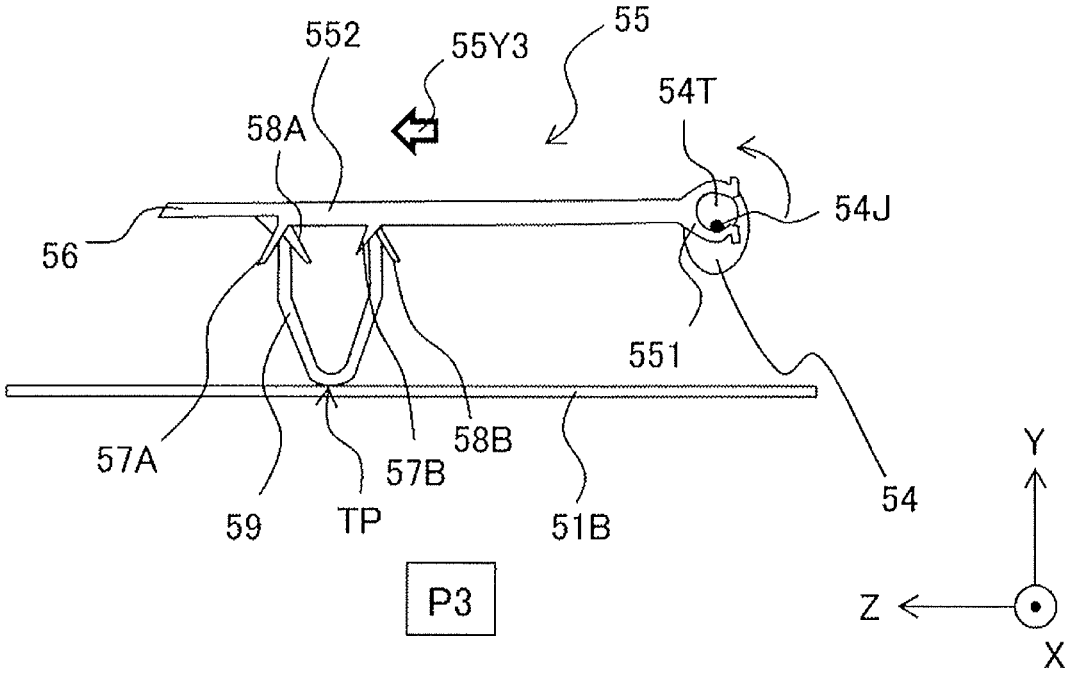
FIG. 6C is a third diagram describing the operation of the developer collection device illustrated in FIG. 2.

When the state of the frame 55 is varied from the state P2 illustrated in FIG. 6B to the state P3 illustrated in FIG. 6C, the frame 55 as a whole may move gradually in the +Z direction as indicated by a thick arrow 55Y2 in FIG. 6B. Upon such a movement of the frame 55, the base 551 and the fins 57B and 58B may further rise in the Y-axis direction, and in contrast, the fins 57A and 58A and the contact 56 may further fall in the Y-axis direction.

In the state P3 illustrated in FIG. 6C, the base 551 may be located at its highest position in the Y-axis direction among the states P1 to P4. Therefore, each of the fins 57A and 58A and the contact 56 may be located at its lowest position in the Y-axis direction among the states P1 to P4. It is to be noted that each of the fins 57B and 58B may be located at its highest position in the Y-axis direction among the states P1 to P4.

Figure 6D:
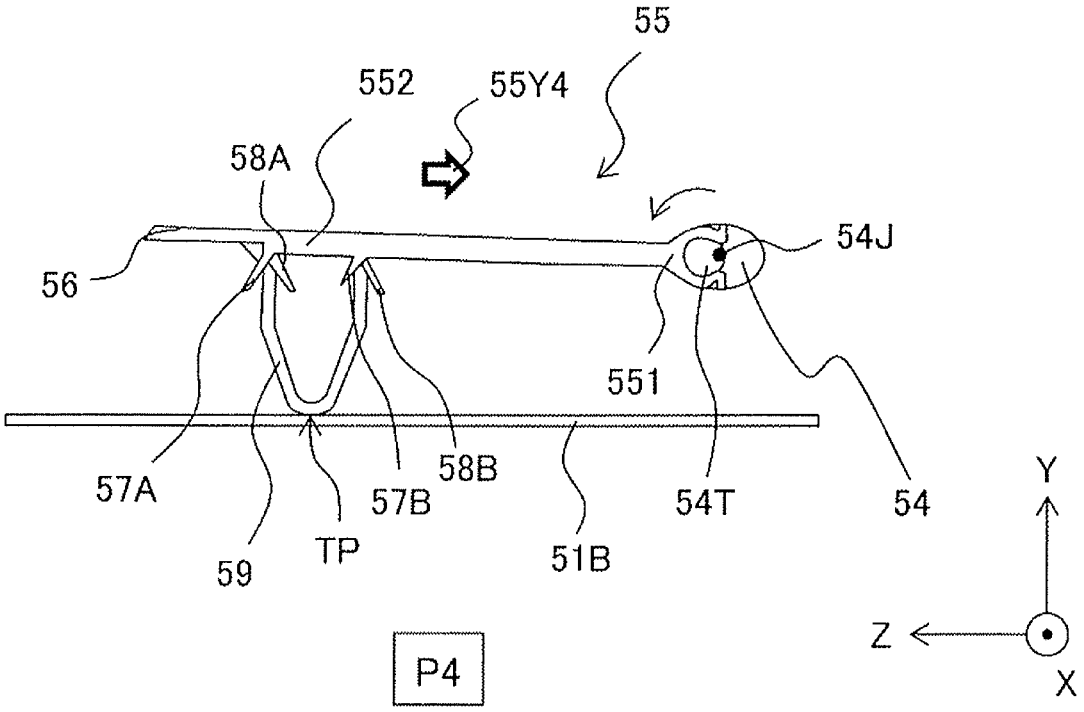
FIG. 6D is a fourth diagram describing the operation of the developer collection device illustrated in FIG. 2.

When the state of the frame 55 is varied from the state P3 illustrated in FIG. 6C to the state P4 illustrated in FIG. 6D, the frame 55 as a whole may be moved gradually in the +Z direction as indicated by a thick arrow 55Y3 in FIG. 6C. Upon such a movement of the frame 55, the base 551 and the fins 57B and 58B may fall gradually in the Y-axis direction, and in contrast, the fins 57A and 58A and the contact 56 may rise gradually in the Y-axis direction.

When the state of the frame 55 is varied from the state P4 illustrated in FIG. 6D to the state P1 illustrated in FIG. 6A, the frame 55 as a whole may be moved gradually in the −Z direction as indicated by a thick arrow 55Y4 in FIG. 6D. Upon such a movement of the frame 55, the base 551 and the fins 57B and 58B may further fall in the Y-axis direction, and in contrast, the fins 57A and 58A and the contact 56 may further rise in the Y-axis direction.

Figure 7:
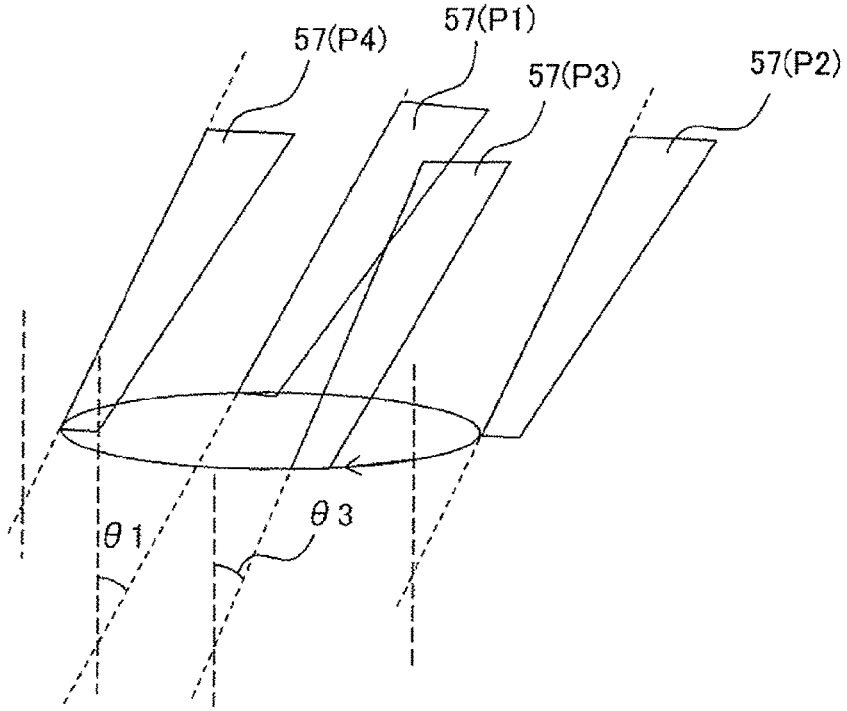
FIG. 7 schematically describes a behavior of part of the developer collection device illustrated in FIG. 4.

Focusing attention on the fin 57A, the fin 57A may so circulate as illustrated in the states P1, P2, P3, and P4 in order that the trajectory of the circulation of the fin 57A forms an elliptical shape as schematically illustrated in FIG. 7, for example. In this example, the fin 57A may rotate clockwise on the paper plane of FIG. 7. The circulation of the fin 57A may be caused by the rotation operation of the rotating member 54 around the rotational axis 54J. In other words, the end 552 may rotate in a rotation direction opposite to the rotation direction of the rotating member 54. The state P2 may be a state in which the fin 57A is located at its position closest to the rotating member 54. The state P4 may be a state in which the fin 57A is located at its position farthest from the rotating member 54. In the state P1, the position of the fin 57A in height may be higher in the Y-axis direction than the position of the fin 57A in height in each of the states P2 and P4. In the state P3, the position of the fin 57A in height may be lower in the Y-axis direction than the position of the fin 57A in height in each of the states P2 and P4. In the state P1, an inclination angle θ1 at which the fin 57A is inclined may be the greatest among the states P1 to P4. In other words, the state P1 may be a state in which the posture of the fin 57A is the closest to the horizontal direction among the states P1 to P4. In contrast, in the state P3, an inclination angle θ3 at which the fin 57A is inclined may be the smallest among the states P1 to P4. In other words, the state P3 may be a state in which the posture of the fin 57A is closest to the vertical direction among the states P1 to P4.

Figure 8A:
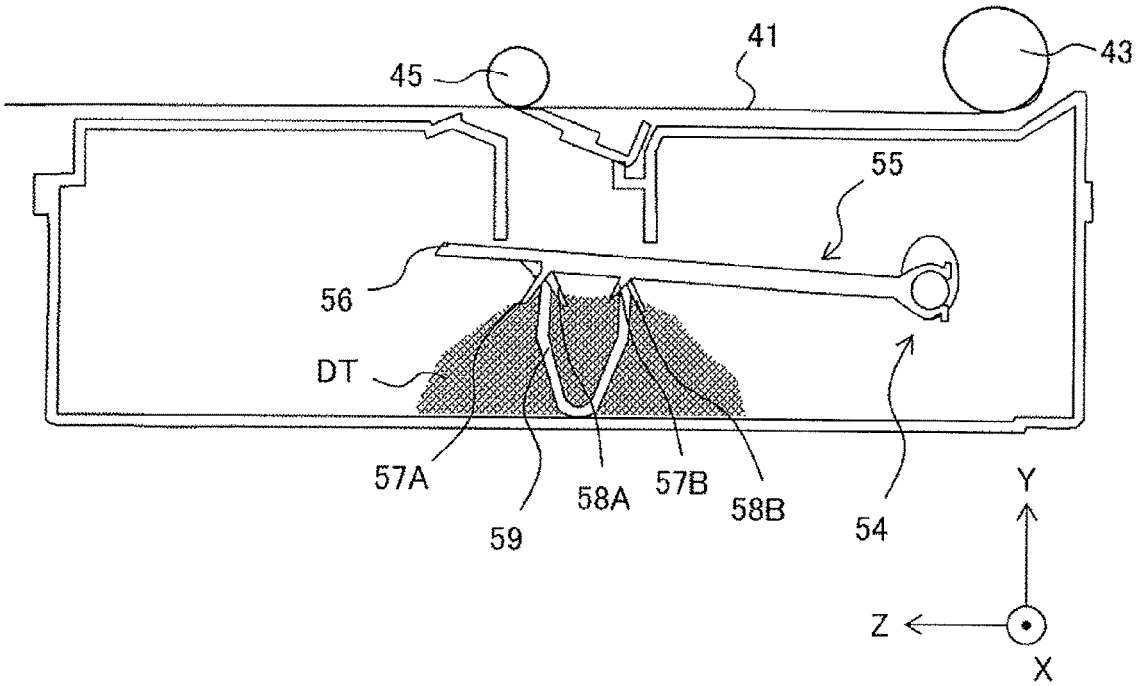
FIG. 8A is a first diagram describing how a developer is accumulated inside a container of the developer collection device illustrated in FIG. 2.
Figure 8B:
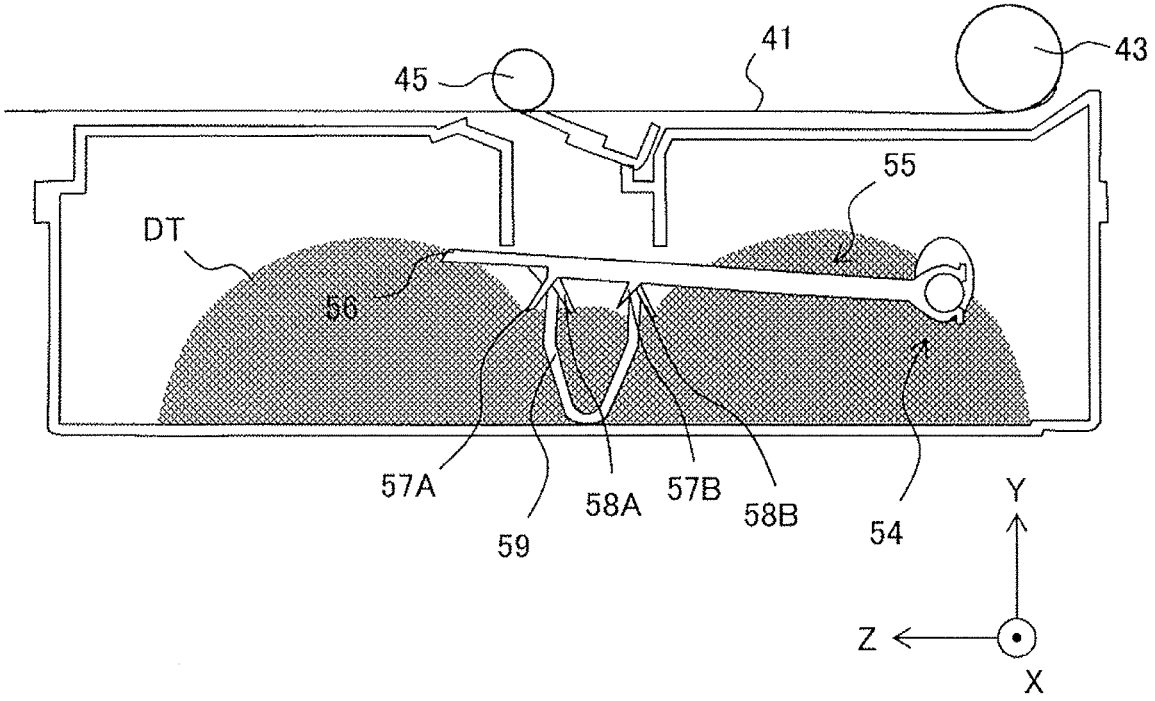
FIG. 8B is a second diagram describing how the developer is accumulated inside the container of the developer collection device illustrated in FIG. 2.
Figure 8C:
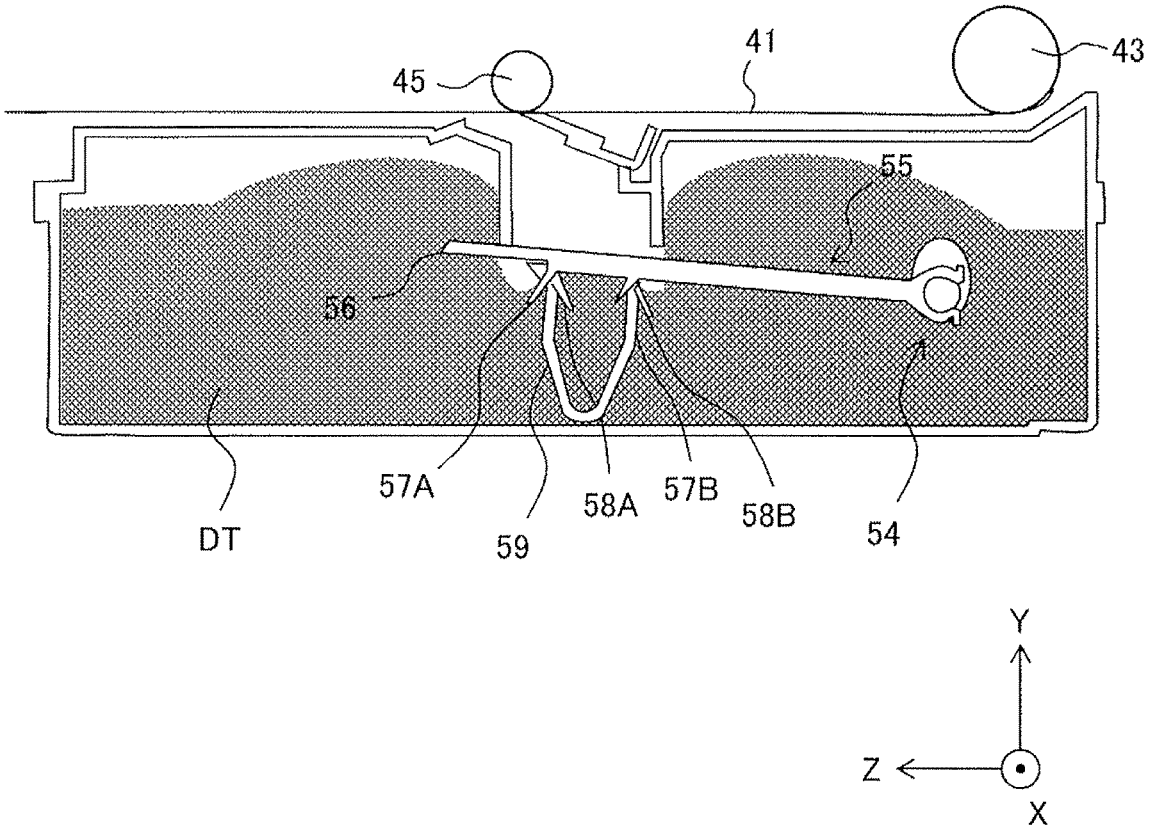
FIG. 8C is a third diagram describing how the developer is accumulated inside the container of the developer collection device illustrated in FIG. 2.

FIGS. 8A to 8C are conceptual diagrams illustrating how the waste toner DT is accumulated inside the container 51 upon the collecting operation of the waste toner DT performed by the developer collection device 105. Referring to FIG. 8A, at the beginning of introduction of the waste toner DT into the empty container 51, the waste toner DT may be accumulated in a region immediately below the opening 51K, and in the course of time, the accumulation of the waste toner DT may reach a height where the accumulated waste toner DT comes into contact with the fins 57A, 57B, 58A, and 58B. Thereafter, when the waste toner DT is further introduced into the container 51, the displacement of the frame 55 provided with the fins 57A, 57B, 58A, and 58B may cause the waste toner DT present in the vicinity of the uppermost layer of the accumulation of the waste toner DT to be moved mainly in the Z-axis direction. This allows the waste toner DT to be accumulated, inside the container 51, in a region other than the region immediately below the opening 51K, as illustrated in FIG. 8B. Further, the height of the accumulation of the waste toner DT accumulated in the region immediately below the opening 51K may be hardly increased, and be maintained at an almost-constant height. When the collecting operation of the waste toner DT further progresses, the height of the accumulation of the waste toner DT accumulated in the region other than the region immediately below the opening 51K inside the container 51 may be further increased, as illustrated in FIG. 8C. In contrast, the height of the accumulation of the waste toner DT accumulated in the region immediately below the opening 51K may be increased slightly; however, the respective positions in height of the fins 57A, 57B, 58A, and 58B may rise only slightly. One reason for this is that the contact 56 may come into contact with the wall W1. It is to be noted that, when the contact 56 comes into contact with the wall W1, the contact 59 provided at the end 552 of the frame 55 may be separated away from the lower part 51B. When the end 552 of the frame 55 so rises that the end 552 is away from the lower part 51B, it is thereby possible to prevent the fins 57A, 57B, 58A, and 58B from being embedded in the accumulated waste toner DT. It is therefore possible to cause the waste toner DT accumulated in the region immediately below the opening 51K to be dispersed promptly in another region even by small driving force.

[C. Example Effects]

As described above, the image forming apparatus 1 according to the example embodiment may include the developer collection device 105 in which the base 551 of the frame 55 is attached to the shaft 54T pivotally, and in contrast, the end 552 of the frame 55 is movable upward and downward without being fixed to a member such as the container 51. Therefore, when the waste toner DT is accumulated inside the container 51, the contact 59 may be separated away from the lower part 51B and the end 552 may rise, in accordance with the displacement of the position in height of the upper surface of the accumulated waste toner DT. Accordingly, the fins 57A, 57B, 58A, and 58B may be constantly located at the respective positions that are in the vicinity of the surface of the waste toner DT, independently of the amount of the accumulated waste toner DT. This moderates imbalance in the height of the accumulated waste toner DT. As a result, the waste toner DT introduced into the container 51 from the opening 51K is moved promptly. This makes it possible to avoid accumulation of the waste toner DT only in the vicinity of the opening 51K.

Hence, the collecting operation of the waste toner DT is performed more smoothly, allowing for a long-time printing operation.

Moreover, the walls W1 and W2 may be provided on the peripheral edge of the opening 51K from which the waste toner DT is introduced into the container 51. This prevents the waste toner DT from overflowing from the opening 51K and being scattered around, even when a great amount of waste toner DT is accumulated inside the container 51 as illustrated in FIG. 8C, for example. Further, the frame 55 may be provided with the contact 56 that is brought into contact with the wall W1 from the position below the wall W1. This limits the rising of the end 552 of the frame 55, and thereby prevents the waste toner DT from overflowing from the container 51. Further, the provision of the contact 56 prevents the frame 55 from losing the function of causing the amount of the accumulated waste toner DT to be equalized.

Moreover, in the developer collection device 105, each of the fins 57A, 57B, 58A, and 58B provided at the end 552 of the frame 55 may so perform the rotation operation that the trajectory of the rotation of each of the fins 57A, 57B, 58A, and 58B forms an elliptical shape. This makes it possible to cause the part of the waste toner DT that is located in the vicinity of the surface of the waste toner DT accumulated in the region immediately below the opening 51K to be dispersed in a peripheral region of the opening 51K more effectively, compared to a case where each of the fins 57A, 57B, 58A, and 58B performs a simple reciprocating operation in the horizontal direction. In particular, the inclination angle of each of the fins 57A and 57B that incline forward may be so varied that the posture of each of the fins 57A and 57B is closer to the vertical direction in the state P3 in which each of the fins 57A and 57B is located at its lowest position among the states P1 to P4, and thereafter, is brought gradually closer to the horizontal direction when each of the fins 57A and 57B is moved forward. Hence, it is possible to move the waste toner DT to the peripheral region of the opening 51K further more effectively.

2. Modification Examples

The technology has been described above referring to the example embodiments. However, the technology is not limited to the example embodiments described above, and is modifiable in various ways. For example, the foregoing example embodiments have been described referring to an example case of the image forming apparatus forming a color image; however, the technology is not limited thereto. For example, the technology is also applicable to an image forming apparatus that transfers only a black toner image and thereby forms a monochrome image. Moreover, the foregoing example embodiments have been described referring to an example case of the image forming apparatus using a primary transfer method, i.e., a direct transfer method; however, the technology is not limited thereto. For example, the technology is also applicable to a secondary transfer method.

Moreover, the shapes, the numbers, the dimensions, and the positional relationships of the respective components described above referring to the example embodiments and the modification examples thereof are mere examples, and the technology is not limited thereto.

Moreover, the example embodiments and the modification examples thereof have been described above referring to an example case where the LED head including the LED as the light source is used as the exposure device; however, the technology is not limited thereto. In one example embodiment, an exposure device that includes a device such as a laser device as the light source may be used, for example.

The foregoing example embodiments and the modification examples thereof have been described referring to the image forming apparatus having a printing function as an example corresponding to the "image forming apparatus" in one specific but non-limiting embodiment of the technology; however, the technology is not limited thereto. Specifically, for example, the technology is also applicable to an image forming apparatus that serves as a multi-function peripheral having functions such as a scanner function and a facsimile function in addition to the printing function, for example.

Moreover, the foregoing example embodiments and the modification examples thereof have been described referring to an example case where the frame 55 is attached to the rotating member 54 pivotally relative to the rotating member 54; however, the technology is not limited thereto. The attachment member may be a member that does not rotate itself. Further, the technology is not limited to a case where the attachment member is fixed to the container. Alternatively, in one example embodiment, the attachment member may be movable in the horizontal direction, for example. The frame may be provided in any manner as long as the frame is swingable relative to the attachment member.

Furthermore, the technology encompasses any possible combination of some or all of the various embodiments and the modifications described herein and incorporated herein.

It is possible to achieve at least the following configurations from the above-described example embodiments of the technology.

(1)

A developer collection device including:

a container having an opening, and containing a developer introduced into the container from the opening;

a frame extending in a first axis direction, and attached, to the container, swingably relative to the container in the first axis direction;

a first fin provided in the container and attached to a first base point of the frame, the first fin extending in a third direction from the first base point, the third direction being a direction inclining downward and thereby forming an angle that is smaller than ninety degrees relative to a first direction, the first direction extending along the first axis direction; and a second fin provided in the container and attached to a second base point of the frame, the second fin extending in a fourth direction from the second base point, the fourth direction being a direction inclining downward and thereby forming an angle that is smaller than ninety degrees relative to a second direction, the second direction being a direction opposite to the first direction.

(2)

The developer collection device according to (1), further including an attachment member that is provided in the container and to which the frame is attached.

(3)

The developer collection device according to (2), in which the attachment member is attached to the container displaceably relative to the container.

(4)

The developer collection device according to (2) or (3), in which the attachment member is a rotating member that rotates around a rotational axis, the rotational axis extending in a second axis direction that is orthogonal to the first axis direction, and the frame is attached to the rotating member pivotally relative to the rotating member.

(5)

The developer collection device according to (4), in which the rotating member includes a shaft that extends in the second axis direction and revolves around the rotational axis, and the frame is pivotable relative to the shaft.

(6)

The developer collection device according to (5), in which the frame includes:

a base that is attached to the shaft pivotally relative to the shaft; and an end that is located on opposite side of the frame to the base in the first axis direction.

(7)

The developer collection device according to (6), in which both of the first base point and the second base point are located at the end of the frame.

(8)

The developer collection device according to (6) or (7), further including a first contact attached to the end of the frame, in which the container includes a wall that is provided at a peripheral edge of the opening and is protruded toward inside of the container, and the first contact is able to be brought into contact with the wall.

(9)

The developer collection device according to (8), in which the wall includes a first part and a second part that face each other in the first axis direction.

(10)

The developer collection device according to any one of (6) to (9), further including a second contact attached to the end of the frame, in which the container includes an upper part and a lower part, the upper part being provided with the opening, the lower part facing the upper part in a vertical direction, and the second contact is able to be brought into contact with the lower part.

(11)

The developer collection device according to (10), in which the first fin is located on opposite side, to the rotating member, of a contact at which the second contact and the lower part are to be brought into contact with each other, and the second fin is located between the rotating member and the contact at which the second contact and the lower part are to be brought into contact with each other.

(12)

The developer collection device according to any one of (6) to (11), in which the rotating member rotates in a first rotation direction, and the end of the frame is caused, by the rotation of the rotating member in the first rotation direction, to rotate in a second rotation direction in a plane orthogonal to the rotational axis, the second rotation direction being a direction that is opposite to the first rotation direction.

(13)

A belt unit including:

a belt to which a developer is to be attached; and a developer collection device that collects the developer attached to the belt, the developer collection device including:

a container having an opening, and containing the developer introduced into the container from the opening;

a frame extending in a first axis direction, and attached, to the container, swingably relative to the container in the first axis direction;

a first fin provided in the container and attached to a first base point of the frame, the first fin extending in a third direction from the first base point, the third direction being a direction inclining downward and thereby forming an angle that is smaller than ninety degrees relative to a first direction, the first direction extending along the first axis direction; and a second fin provided in the container and attached to a second base point of the frame, the second fin extending in a fourth direction from the second base point, the fourth direction being a direction inclining downward and thereby forming an angle that is smaller than ninety degrees relative to a second direction, the second direction being a direction opposite to the first direction.

(14)

An image forming apparatus including:

an image forming unit including an image supporting body that supports a developer image, the developer image including a developer; and a belt unit including a belt and a developer collection device, the belt conveying a medium while sandwiching the medium between the image supporting body and the belt, the developer collection device collecting the developer attached to the belt, the developer collection device including:

a container having an opening, and containing the developer introduced into the container from the opening;

a frame extending in a first axis direction, and attached, to the container, swingably relative to the container in the first axis direction;

a first fin provided in the container and attached to a first base point of the frame, the first fin extending in a third direction from the first base point, the third direction being a direction inclining downward and thereby forming an angle that is smaller than ninety degrees relative to a first direction, the first direction extending along the first axis direction; and a second fin provided in the container and attached to a second base point of the frame, the second fin extending in a fourth direction from the second base point, the fourth direction being a direction inclining downward and thereby forming an angle that is smaller than ninety degrees relative to a second direction, the second direction being a direction opposite to the first direction.

In any of the developer collection device, the belt unit, and the image forming apparatus according to one embodiment of the technology, the frame to which the first fin and the second fin are attached inside the container is provided swingably relative to the container. Accordingly, the developer introduced into the container from the opening is moved by the frame. It is therefore possible to avoid accumulation of the developer only in the vicinity of the opening.

According to any of the developer collection device, the belt unit, and the image forming apparatus according to one embodiment of the technology, it is possible to perform the collecting operation of the developer more smoothly. It is to be noted that the effects of the technology are not limited thereto. The effects of the technology may include any of the effects described herein.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A developer collection device, comprising:

a container having an opening, and containing a developer introduced into the container from the opening, the container including a wall that is provided at a peripheral edge of the opening and being protruded toward inside of the container;

an attachment member rotatably provided in the container;

a frame extending in a first direction, and being swingably attached to the attachment member, the first direction extending away from the attachment member, the frame including a first contact located at a one side opposite to an other side at which the attachment member is disposed, the first contact being able to be brought into contact with the wall of the container, the frame having a first base point and a second base point, the first direction being opposite to a second direction;

a first fin provided at the first base point of the frame, the first fin extending from the first base point in a third direction inclining downward, an angle between the third direction and the first direction being smaller than ninety degrees; and a second fin provided at the second base point of the frame, the second fin extending from the second base point in a fourth direction inclining downward, an angle between the fourth direction and the second direction being smaller than ninety degrees.

2. The developer collection device according to claim 1, wherein the attachment member is a rotating member that rotates around a rotational axis, the rotational axis extending in an axial direction that is orthogonal to the first direction, and the frame is pivotally attached to the rotating member.

3. The developer collection device according to claim 2, wherein the rotating member includes a shaft that extends in the axial direction and revolves around the rotational axis, and the frame is pivotally provided at the shaft.

4. The developer collection device according to claim 3, wherein the frame is pivotally attached to the shaft.

5. The developer collection device according to claim 4, wherein the frame further includes a second contact disposed away from the attachment member in the first direction, and the container includes an upper part and a lower part, the upper part being provided with the opening, the lower part facing the upper part in a vertical direction, the second contact being able to be brought into contact with the lower part.

6. The developer collection device according to claim 5, wherein the second contact is brought into contact with the lower part at a contact point, a corresponding position of the contact point at the frame is located between positions at which the first fin and the second fin are disposed.

7. The developer collection device according to claim 4, wherein the frame includes:

a base pivotally attached to the shaft at a one side of the frame; and an end portion located at an other side opposite to the one side of the frame in the first direction, the rotating member rotates in a first rotation direction, and the end portion of the frame is caused, by the rotation of the rotating member in the first rotation direction, to rotate in a second rotation direction in a plane orthogonal to the rotational axis, the second rotation direction being opposite to the first rotation direction.

8. The developer collection device according to claim 1, wherein the frame include an end portion in which both of the first base point and the second base point are provided, the end portion including the first contact.

9. The developer collection device according to claim 1, wherein the wall includes a first part and a second part that face each other.

10. The developer collection device according to claim 1, wherein the container includes a facing part positioned to face the opening, the frame includes a second contact that is able to be brought into contact with the facing part, the first fin includes a plurality of first fins each of which is disposed along the first direction, and the facing part and the second contact are brought into contact with each other between adjacent two of the plurality of first fins.

11. The developer collection device according to claim 1, wherein the first fin and the second fin are positioned to face the opening in a vertical direction.

12. A belt unit, comprising:

a belt to which a developer is to be attached; and a developer collection device that collects the developer attached to the belt, the developer collection device including:

a container having an opening, and containing a developer introduced into the container from the opening, the container including a wall that is provided at a peripheral edge of the opening and being protruded toward inside of the container;

an attachment member rotatably provided in the container;

a frame extending in a first direction, and being swingably attached to the attachment member, the first direction extending away from the attachment member, the frame including a first contact located at a one side opposite to an other side at which the attachment member is disposed, the first contact being able to be brought into contact with the wall of the container, the frame having a first base point and a second base point, the first direction being opposite to a second direction;

a first fin provided at the first base point of the frame, the first fin extending from the first base point in a third direction inclining downward, an angle between the third direction and the first direction being smaller than ninety degrees; and a second fin provided at the second base point of the frame, the second fin extending from the second base point in a fourth direction inclining downward, an angle between the fourth direction and the second direction being smaller than ninety degrees.

13. An image forming apparatus, comprising:

an image forming unit including an image supporting body that supports a developer image, the developer image including a developer; and a belt unit including a belt and a developer collection device, the belt conveying a medium while sandwiching the medium between the image supporting body and the belt, the developer collection device collecting the developer attached to the belt, the developer collection device including:

a container having an opening, and containing a developer introduced into the container from the opening, the container including a wall that is provided at a peripheral edge of the opening and being protruded toward inside of the container;

an attachment member rotatably provided in the container;

a frame extending in a first direction, and being swingably attached to the attachment member, the first direction extending away from the attachment member, the frame including a first contact located at a one side opposite to an other side at which the attachment member is disposed, the first contact being able to be brought into contact with the wall of the container, the frame having a first base point and a second base point, the first direction being opposite to a second direction;

a first fin provided at the first base point of the frame, the first fin extending from the first base point in a third direction inclining downward, an angle between the third direction and the first direction being smaller than ninety degrees; and a second fin provided at the second base point of the frame, the second fin extending from the second base point in a fourth direction inclining downward, an angle between the fourth direction and the second direction being smaller than ninety degrees.

* * * * *